US010714257B2

(12) United States Patent
Komiyama et al.

(10) Patent No.: US 10,714,257 B2
(45) Date of Patent: Jul. 14, 2020

(54) WINDING BOBBIN AND WINDING COMPONENT

(71) Applicant: HIOKI DENKI KABUSHIKI KAISHA, Nagano (JP)

(72) Inventors: Tetsuya Komiyama, Nagano (JP); Kazunobu Hayashi, Nagano (JP)

(73) Assignee: HIOKI DENKI KABUSHIKI KAISHA, Nagano (JP)

( * ) Notice: Subject to any disclaimer, the term of this patent is extended or adjusted under 35 U.S.C. 154(b) by 206 days.

(21) Appl. No.: 16/012,053

(22) Filed: Jun. 19, 2018

(65) Prior Publication Data

US 2018/0374633 A1 Dec. 27, 2018

(30) Foreign Application Priority Data

Jun. 21, 2017 (JP) ..... 2017-120992

(51) Int. Cl.

| | |
|---|---|
| ***H01F 27/30*** | (2006.01) |
| ***H01F 27/32*** | (2006.01) |
| ***H01F 27/28*** | (2006.01) |
| ***H01F 5/02*** | (2006.01) |

(52) U.S. Cl.

CPC ..... *H01F 27/325* (2013.01); *H01F 5/02* (2013.01); *H01F 27/2828* (2013.01); *H01F 27/2895* (2013.01); *H01F 27/30* (2013.01); *H01F 27/306* (2013.01); *H01F 27/2847* (2013.01); *H01F 2005/022* (2013.01)

(58) Field of Classification Search

CPC ..... H01F 27/00–36
USPC ..... 336/65, 90, 92, 96, 196, 198, 220–223, 336/225, 229
See application file for complete search history.

(56) References Cited

U.S. PATENT DOCUMENTS

| | | | | |
|---|---|---|---|---|
| 3,564,708 | A * | 2/1971 | Harris | H01F 27/2804 29/606 |
| 4,833,436 | A * | 5/1989 | Martin | H01F 27/306 29/606 |
| 5,214,403 | A * | 5/1993 | Bogaerts | H01F 27/2804 336/200 |
| 6,876,287 | B2 * | 4/2005 | Matsuura | G01D 5/2086 336/192 |
| 2009/0128273 | A1 * | 5/2009 | Huss | H01F 27/2895 336/61 |

FOREIGN PATENT DOCUMENTS

| | | |
|---|---|---|
| JP | 2017-11009 | 1/2017 |

* cited by examiner

*Primary Examiner* — Tuyen T Nguyen
(74) *Attorney, Agent, or Firm* — Greenblum & Bernstein, P.L.C.

(57) ABSTRACT

A winding bobbin includes a bobbin main body constructed in a ring shape so as to house a ring-shaped core and a plurality of partitions that are provided at intervals in a circumferential direction of the bobbin main body and formed so as to protrude from a surface of the bobbin main body. A winding is formed by winding a conductive wire in winding regions on the surface that are partitioned by the partitions. The partitions each include a flange that is formed of a U-shaped plate that protrudes from the surface at three positions out of four positions that are an outer circumference, an inner circumference, and two sides of the bobbin main body, with one position omitted, and a protrusion that is formed so as to protrude from at least one out of two opening-side ends of the flange.

5 Claims, 6 Drawing Sheets

WINDING BOBBIN AND WINDING COMPONENT

FIELD OF THE INVENTION

The present invention relates to a winding bobbin equipped with a ring-shaped bobbin main body and a plurality of partitions provided on the surface of the bobbin main body, and to a winding component equipped with the winding bobbin.

DESCRIPTION OF THE RELATED ART

One example of this type of winding component is the winding component disclosed by the present applicant in Patent Literature 1 (Japanese Laid-open Patent Publication No. 2017-11009 (see pages 4 to 5 and FIGS. 1 to 4). This winding component includes a core, a plurality of flange-like partitions that are erected on the surface of the core, and windings that are formed by winding a conductive wire in winding formation positions on the surface of the core that are partitioned by the partitions. In this configuration, the partitions are formed on only the outer circumferential surface out of the inner circumferential surface, the two side surfaces, and the outer circumferential surface of the core. The windings are constructed by winding at adjacent winding formation positions via the side surfaces or inner circumferential surface of the core which are positions where the partitions are not formed (hereinafter referred to in the specification as "partitionless positions"), so that the plurality of individual windings formed in the respective winding formation positions are connected using the partitionless positions.

SUMMARY OF THE INVENTION

However, there is the following problem to be solved for the winding component described above. In more detail, with the winding component described above, partitions are formed on only the outer circumferential surface of the core and partitions are not formed on the inner circumferential surface and the side surfaces of the core. For this reason, with the winding component described above, at the inner circumferential surface and the side surfaces of the core that are partitionless positions, the conductive wire used to form the individual windings can protrude into other winding formation positions that are adjacent, resulting into the windings "collapsing". This makes it difficult to form uniform windings, resulting in the risk of fluctuations being produced in the properties. Also, with the winding component described above, at the inner circumferential surface and the side surfaces of the core that are partitionless positions, the windings in adjacent winding formation positions may contact each other, and the parasitic capacitance this produces is difficult to suppress.

The present invention was conceived in view of the problems described above and has a principal object of providing a winding bobbin and a winding component that are capable of reducing fluctuations in properties and parasitic capacitance.

To achieve the stated object, a winding bobbin according to the present invention comprises: a bobbin main body constructed in a ring shape so as to be capable of housing a ring-shaped core; and a plurality of partitions that are provided at intervals in a circumferential direction of the bobbin main body and are formed so as to protrude from a surface of the bobbin main body, wherein a winding is formed by winding a conductive wire in winding regions on the surface that are partitioned by the partitions, and the partitions each include: a flange that is formed of a U-shaped plate that protrudes from the surface at three positions out of four positions that are an outer circumference, an inner circumference, and two sides of the bobbin main body, with one position omitted; and a protrusion that is formed so as to protrude from at least one out of two opening-side ends of the flange.

To achieve the stated object, a winding component according to the present invention comprises:

a winding bobbin including a bobbin main body constructed in a ring shape so as to be capable of housing a ring-shaped core and a plurality of partitions that are provided at intervals in a circumferential direction of the bobbin main body and are formed so as to protrude from a surface of the bobbin main body, wherein a winding is formed by winding a conductive wire in winding regions on the surface that are partitioned by the partitions, and the partitions each include a flange that is formed of a U-shaped plate that protrudes from the surface at three positions out of four positions that are an outer circumference, an inner circumference, and two sides of the bobbin main body, with one position omitted, and a protrusion that is formed so as to protrude from at least one out of two opening-side ends of the flange; the ring-shaped core that is housed in the winding bobbin; and the winding that is formed in the winding regions of the winding bobbin.

According to the above winding bobbin and the winding component, by constructing the respective partitions so as to include the flanges that are formed as U-shaped plates that protrude from the surface at three positions out of four positions that are the outer circumference, the inner circumference, and the two sides of the bobbin main body with one position omitted, compared to the conventional configuration where the partitions are formed only on the surface at the outer circumference, it is possible to suppress collapsing of the windings of the conductive wire that can cause fluctuations in the properties of the winding component and contact between individual windings in adjacent winding regions that can produce parasitic capacitance. Also, according to the above winding bobbin and the winding component, by constructing the respective partitions so as to include the protrusions that are formed so as to protrude from at least one of the two opening-side ends of the flanges, it is possible to suppress protrusion of the conductive wire into adjacent winding regions, even at positions where flanges are not formed in the winding regions. As a result, it is possible to suppress collapsing of the windings and contact between the windings in respective adjacent winding regions, even at positions where flanges are not formed in the winding regions. Accordingly, with the above winding bobbin and the winding component, it is possible to sufficiently suppress both fluctuations in the properties of the winding component due to collapsing and parasitic capacitance caused by contact between the windings in adjacent winding regions.

Also, in the winding bobbin according to the present invention, the flange is formed of the U-shaped plate that protrudes from the surface at three positions that do not include the inner circumference.

In other words, with the above winding bobbin, the surface at the inner circumference of the bobbin main body is a partitionless position where flanges are not formed. With a configuration where the flanges are formed at the inner circumference of the winding regions where the length of the surface is shorter than the length of the surface at the outer circumference and the length of the surface at the sides, the length of the surface of the winding regions at the inner circumference will become even shorter, which makes "fattening" of the winding that can cause fluctuations in the properties more likely to occur. On the other hand, according to the winding bobbin described above, by setting the surface at the inner circumference as a partitionless position where the flanges are not formed, compared to a configuration where the flanges are formed at the inner circumference, it is possible to suppress the occurrence of fattening. As a result, it is possible to sufficiently suppress fluctuations in the properties of a winding component due to fattening.

Also, in the winding bobbin according the present invention, the protrusion is formed on both of the two opening-side ends of the flange.

With the above winding bobbin, by forming the protrusions on the two opening-side ends of the flanges, compared to a configuration where a protrusion is formed on only one of the opening-side ends, it is possible to suppress collapsing of the windings at the position of the winding regions where the flanges are not formed and contact between the windings in adjacent winding regions more thoroughly. As a result, it is possible to further reduce both fluctuations in the properties of the winding component due to the collapsing of the windings and parasitic capacitance due to contact between the windings in adjacent winding regions.

It should be noted that the disclosure of the present invention relates to the contents of Japanese Patent Application No. 2017-120992 that was filed on Jun. 21, 2017, the entire contents of which are herein incorporated by reference.

BRIEF DESCRIPTION OF THE DRAWINGS

These and other objects and features of the present invention will be explained in more detail below with reference to the attached drawings, wherein.

DESCRIPTION OF THE PREFERRED EMBODIMENTS

Preferred embodiments of a winding bobbin and a winding component will now be described with reference to the attached drawings.

Figure 1:
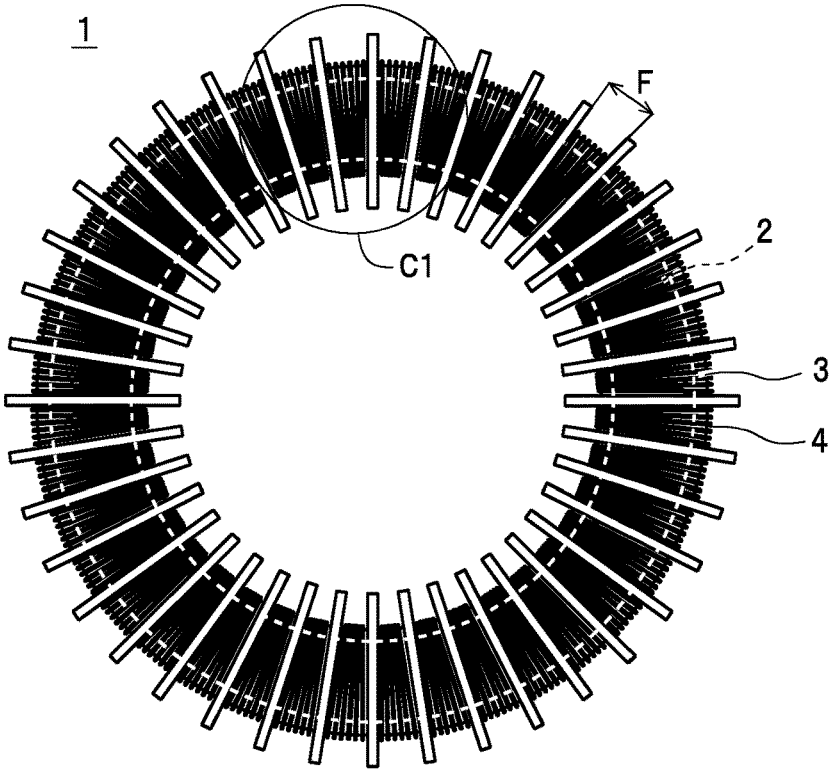
FIG. 1 is a plan view of a winding component 1.
Figure 2:
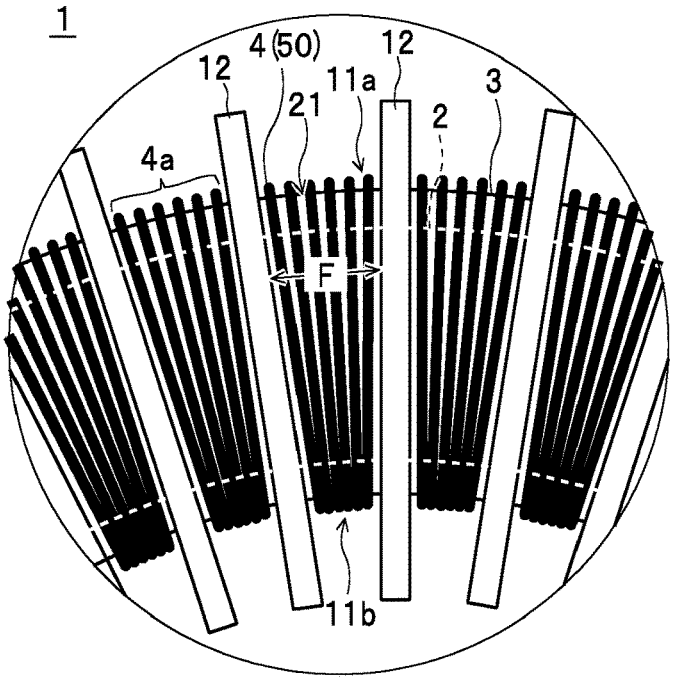
FIG. 2 is a plan view of the winding component 1 in which a part surrounded by a circle C1 in FIG. 1 is enlarged.

First, the configuration of a winding component 1 depicted in FIG. 1 will be described as one example of a winding component according to the present invention. As one example, the winding component 1 is a toroidal coil used as a current sensor that detects the current flowing in a conductor in a contactless state (i.e., without contacting the conductor), and as depicted in FIG. 1 and FIG. 2, is equipped with a core 2, a bobbin 3 (or "winding bobbin"), and a winding 4.

Figure 3:
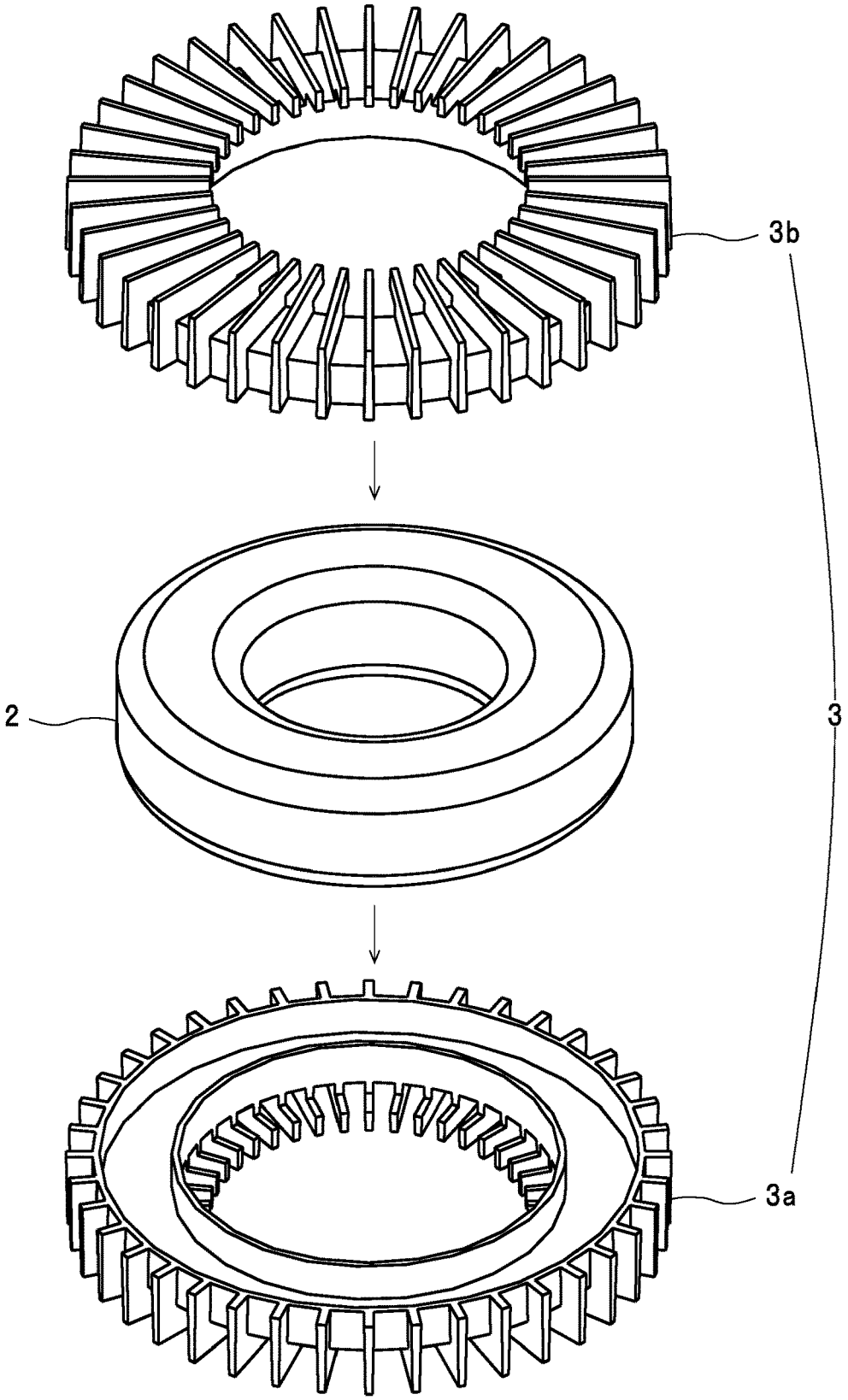
FIG. 3 is an exploded perspective view of a core 2 and a bobbin 3.

As depicted in FIG. 3, the core 2 is formed of a magnetic material in a ring (toroidal) shape.

Figure 4:
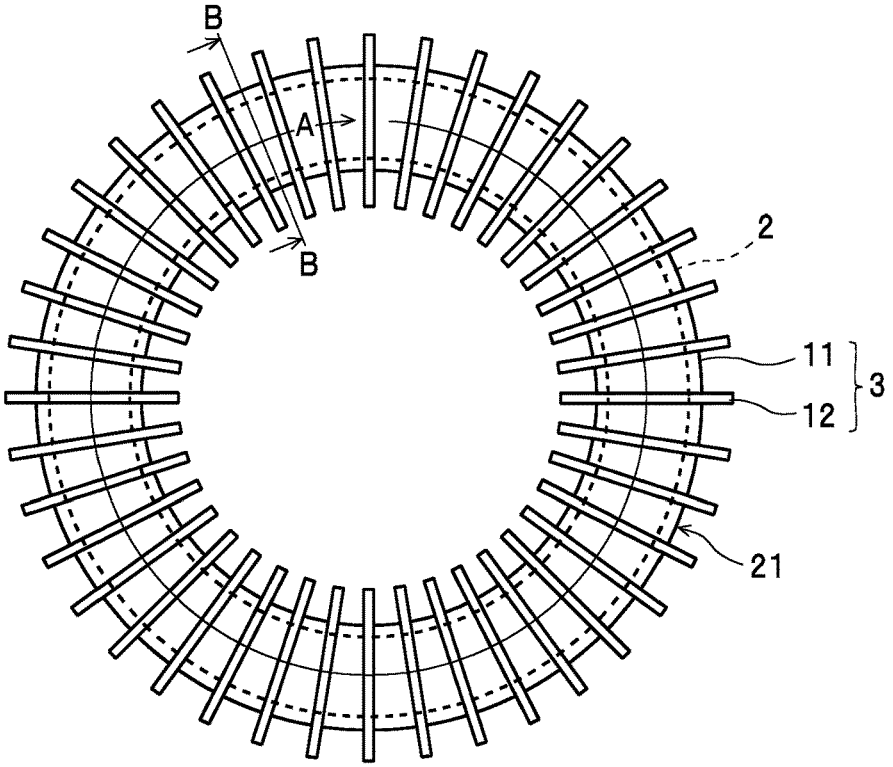
FIG. 4 is a plan view of the core 2 and the bobbin 3.
Figure 5:
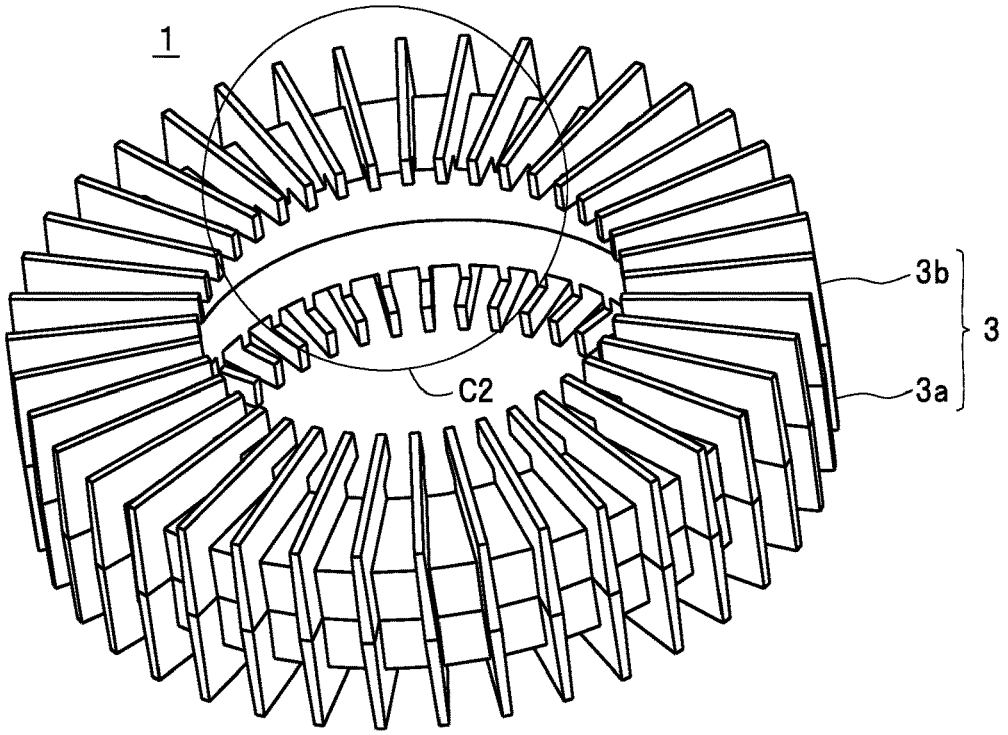
FIG. 5 is a perspective view of the bobbin 3.
Figure 6:
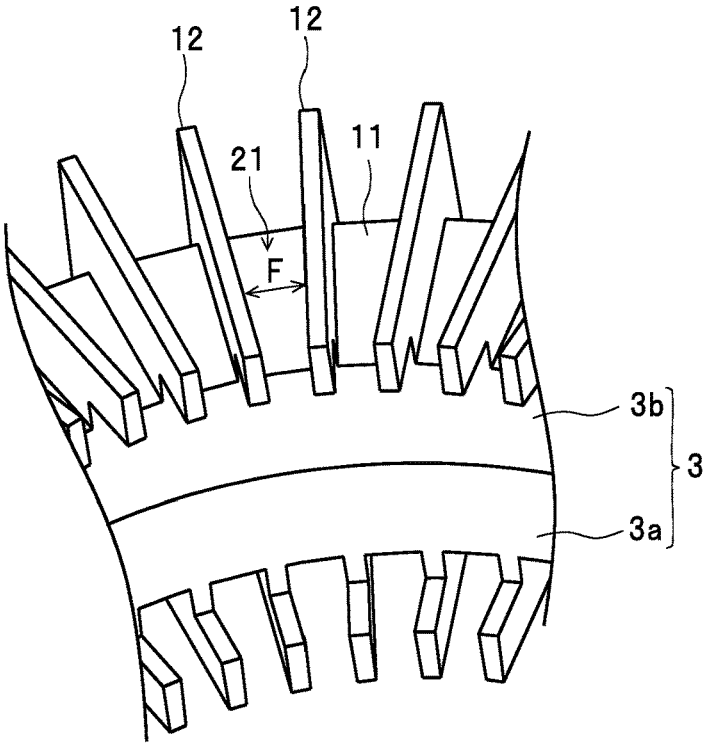
FIG. 6 is a perspective view of the bobbin 3 in which a part surrounded by a circle C2 in FIG. 5 is enlarged.

As depicted in FIG. 4, the bobbin 3 includes a bobbin main body 11 and a plurality of partitions 12 (as one example, forty partitions 12). As depicted in FIGS. 3, 5, and 6, the bobbin 3 is configured so as to be split at a central position in the thickness direction into two members, namely a "first member 3*a*" and a "second member 3*b*". That is, the bobbin 3 is constructed of the first member 3*a* and the second member 3*b* that are formed with the same thickness (or substantially the same thickness) and are capable of fitting together.

Figure 7:
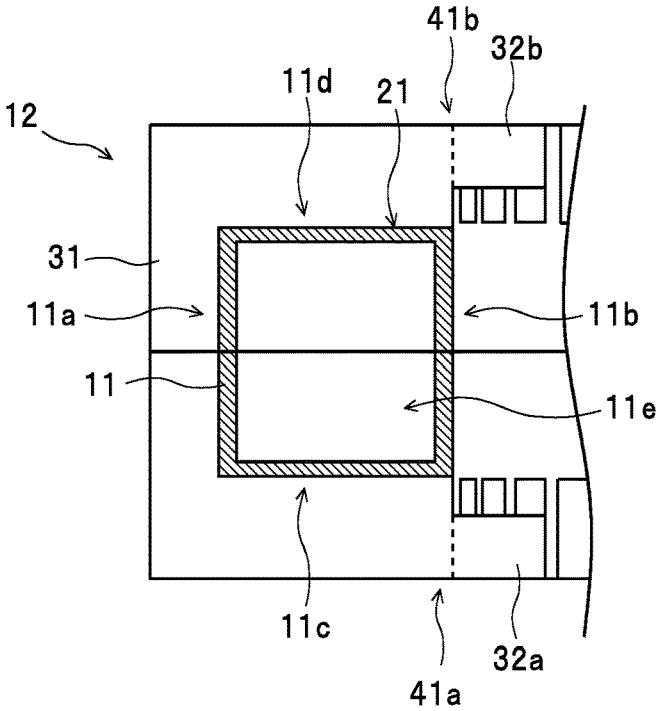
FIG. 7 is a cross-sectional view along a line B-B in FIG. 4.

The bobbin main body 11 is formed for example of an insulating material such as resin, and as depicted in FIG. 4, is constructed in a ring shape so as to be capable of housing the core 2. As depicted in FIG. 7, the bobbin main body 11 is formed with a cross section in the form of a rectangular frame and is provided with a housing 11*e* that internally houses the core 2.

The partitions 12 are members that partition a surface 21 of the bobbin main body 11, and as depicted in FIG. 4, the partitions 12 are provided on the surface 21 of the bobbin main body 11 at intervals along a circumferential direction A of the bobbin main body 11 (in the present embodiment, at fixed (i.e., equal) intervals). As depicted in FIGS. 6 and 7, the partitions 12 are formed so as to protrude from the surface 21 of the bobbin main body 11. More specifically, as depicted in FIG. 7, the partitions 12 include flanges 31 and protrusions 32*a* and 32*b* (hereinafter referred to as the "protrusions 32" when not distinguishing between the protrusions 32*a* and 32*b*).

As depicted in FIG. 7, the flanges 31 are formed of plates that are U-shaped in plan view (the expression "plan view" here refers to the state when looking from the circumferential direction A depicted in FIG. 4) that protrude perpendicularly from the surface 21 at three positions, namely the outer circumference 11*a* and the sides 11*c* and 11*d*, out of the outer circumference 11*a*, the inner circumference 11*b*, and the sides 11*c* and 11*d* of the bobbin main body 11, with the inner circumference 11*b* omitted as one example of "one position" for the present invention. That is, the surface 21 at the inner circumference 11*b* of the bobbin main body 11 is a partitionless position where the flanges 31 are not formed.

As depicted in FIG. 7, the protrusions 32*a* and 32*b* are formed so as to protrude in a direction toward the center of the bobbin 3 (rightward in FIG. 7) from the two opening-side ends (i.e., the ends on the right in FIG. 7) of the flanges 31.

By providing the partitions 12 that protrude from the surface 21 of the bobbin main body 11, as depicted in FIGS. 2 and 6, a plurality of winding regions F (as described later, regions in which the conductive wire 50 is wound, in this example, forty regions) that are partitioned at equal intervals by the partitions 12 are provided on the surface 21 of the bobbin 3.

The winding 4 is formed by winding the conductive wire 50 in the winding regions F described above. Note that the windings wound in the individual winding regions F, or in other words, the elements that construct the winding 4, are also referred to as the "unit windings 4*a*" (see FIG. 2). Although the unit windings 4*a* are formed with the same number of turns in this example, it is also possible to form the unit windings 4*a* with different numbers of turns. Also, the unit windings 4*a* may be formed of a single layer or may be formed of multiple layers in a range where the thickness of an individual winding from the surface 21 of the core 2 is below the height of the partitions 12.

As described above, on the winding component 1, the surface 21 on the inner circumference 11*b*-side of the bobbin main body 11 is a partitionless position where the flanges 31 are not formed. After a unit winding 4*a* has been formed in a given winding region F, when a unit winding 4*a* is formed in the next adjacent winding region F, the conductive wire 50 is wound so as to cross the surface 21 at the inner circumference 11*b* that is a partitionless position where no flanges 31 are formed. This means that the conductive wire 50 is not wound so as to cross any of the partitions 12, and as a result, a situation where stress is applied to the conductive wire 50 due to the conductive wire 50 crossing a partition 12 is completely prevented.

Next, one example of a method of assembling the winding component 1 will be described with reference to the drawings.

First, as depicted in FIG. 3, the core 2 is inserted into the first member 3*a* (i.e., half the bobbin main body 11) that constructs the bobbin 3 and then the second member 3*b* that also constructs the bobbin 3 is fitted onto the first member 3*a* so as to cover the core 2 with the second member 3*b*. By doing so, the core 2 is housed in the housing 11*e* (see FIG. 7) of the bobbin main body 11 of the bobbin 3. Note that in the following description, the core 2 and the bobbin 3 in this state where the core 2 is housed in the bobbin 3 are also collectively referred to as the "winding component main body 10" (see FIG. 8).

Next, the winding 4 is formed. Here, although it is possible to form the winding 4 by a manual operation, an example where a toroidal coil winder 60 is used to form the winding 4 is described below.

Figure 8:
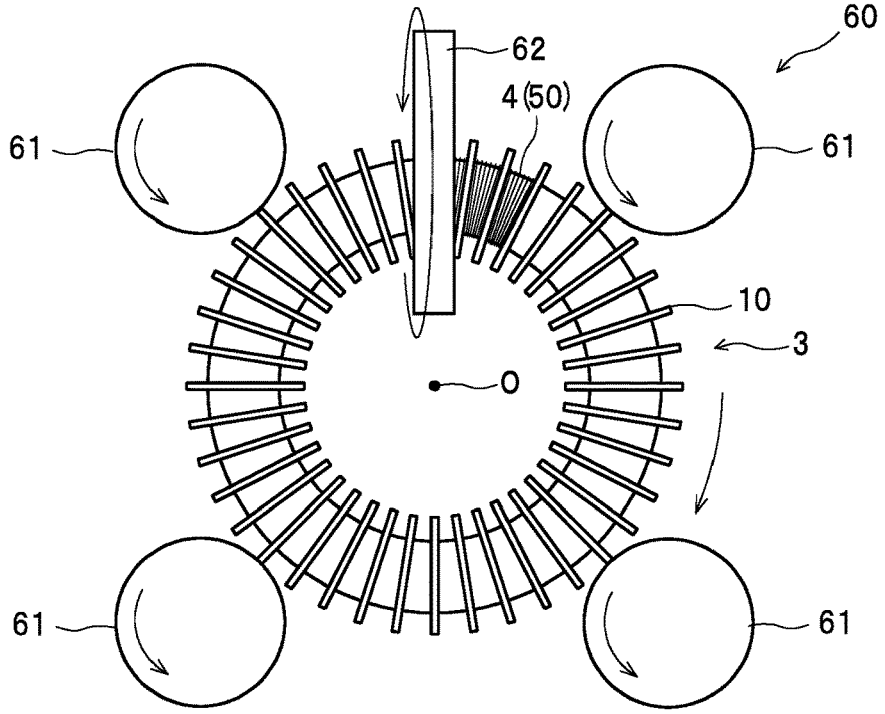
FIG. 8 is a diagram useful in explaining a method of forming the winding 4 on the bobbin 3.

As depicted in FIG. 8, the toroidal coil winder 60 of this type includes a plurality of rollers 61 (here, four rollers 61) that contact the outer circumference of the bobbin 3 (in this example, the front ends of plates 41 depicted in FIG. 7) and cause the winding component main body 10 to rotate about a center O, a shuttle ring 62 that is formed in a ring shape, is capable of holding the conductive wire 50, and winds the conductive wire 50 around the winding component main body 10 by rotating in a state where the shuttle ring 62 is disposed so as to be perpendicular to the winding component main body 10, and a control unit, not illustrated, that controls rotation of the respective rollers 61 and rotation of the shuttle ring 62.

When the toroidal coil winder 60 described above is used to form the winding 4, as depicted in FIG. 8, the winding component main body 10 is set so that the rollers 61 contact the outer circumference of the bobbin 3 and then the toroidal coil winder 60 is started. After this, the control unit starts rotation of the rollers 61 and the shuttle ring 62. By doing so, winding of the conductive wire 50 onto the winding component main body 10 for the conductive wire 50 starts.

Here, when the conductive wire 50 has been wound for a number of turns decided in advance to form a unit winding 4*a* in one winding region F (see FIGS. 2 and 5) of the bobbin 3, the control unit controls rotation of the rollers 61 and the shuttle ring 62 so that the conductive wire 50 crosses the surface 21 at the inner circumference 11*b* of the bobbin main body 11 (i.e., the partitionless position where no flanges 31 are formed: see FIG. 7) to move to the next winding region F that is adjacent. In this way, by causing the conductive wire 50 to cross the partitionless position with no flanges 31 to the next winding region F that is adjacent, a situation where stress is applied to the conductive wire 50 due to the conductive wire 50 being wound so as to cross a partition 12 is completely prevented.

Also, with the bobbin 3, since the flanges 31 of the partitions 12 are formed of plates which are U-shaped in plan view and protrude perpendicularly from the surface 21 at three positions composed of the outer circumference 11*a* and the sides 11*c* and 11*d* of the bobbin main body 11, compared to the conventional configuration where the partitions 12 are formed on only the surface 21 at the outer circumference 11*a*, collapsing of the windings of the conductive wire 50 that can cause fluctuations in the properties of the winding component 1 can be suppressed.

Also, with the bobbin 3, the protrusions 32*a* and 32*b* are formed so as to protrude from the two opening-side ends 41*a* and 41*b* of the flanges 31. This means that with the bobbin 3, it is possible to suppress the amount of conductive wire 50 that protrudes into the next adjacent winding region F even at the inner circumference 11*b* of a winding region F where the flanges 31 are not formed. As a result, it is possible to suppress collapsing of the individual windings, even at the inner circumference 11*b* of the winding regions F.

Since the bobbin 3 has the protrusions 32*a* and 32*b* formed on both of the opening-side ends 41*a* and 41*b* of the flanges 31, compared to a configuration where a protrusion 32 is formed on only one of the opening-side ends 41*a* and 41*b*, it is possible to suppress collapsing of the windings at the inner circumference 11*b* of the winding regions F more thoroughly.

With the bobbin 3, the flanges 31 are formed of plates that are U-shaped in plan view and protrude perpendicularly from the surface 21 at the outer circumference 11*a* and the sides 11*c* and 11*d* of the bobbin main body 11 (i.e., three positions but not the inner circumference 11*b*). That is, the surface 21 of the inner circumference 11*b* is a partitionless position where the flanges 31 are not formed. Here, since the perimeter (i.e., the length around the outside) of the surface 21 at the inner circumference 11*b* of the bobbin main body 11 is shorter than the perimeter of the surface 21 at the outer circumference 11*a*, the length of the surface 21 at the inner circumference 11*b* in each winding region F is shorter than the length of the surface 21 at the outer circumference 11*a* and the lengths of the surface 21 at the sides 11*c* and 11*d*. This means that when the number of turns of the conductive wire 50 wound in the winding regions F is high, it is easy for "fattening", where the winding becomes fat due to parts of the conductive wire 50 overlapping one another, to occur at the inner circumference 11*b* of the winding region F. Fattening can cause fluctuations in the properties of the winding component 1. With a configuration where the flanges 31 are formed on the inner circumference 11*b* of the bobbin main body 11, the length of the inner circumference 11*b* in a winding region F will be shorter by the thickness of a flange 31, which causes a corresponding increase in the likelihood of fattening and fluctuations in the properties of the winding component 1 due to fattening. With the bobbin 3 however, since the inner circumference 11*b* is a partitionless position where the flanges 31 are not formed, compared to a configuration where the flanges 31 are formed on the inner circumference 11*b*, it is possible to suppress the occurrence of fattening, and as a result, it is possible to suppress fluctuations in the properties of the winding component 1 due to fattening.

After this, when the unit windings 4*a* have been formed on all of the winding regions F, the control unit stops the rollers 61 and the shuttle ring 62. By doing so, the winding 4 composed of the unit windings 4*a* is formed on the winding component main body 10 to complete the winding component 1. After this, the winding component 1 (that is, the winding component main body 10 on which the winding 4 has been formed) is removed from the toroidal coil winder 60. By doing so, assembly of the winding component 1 is completed.

In this way, according to the bobbin 3 and the winding component 1, the partitions 12 include the flanges 31 that are formed of U-shaped plates that protrude from the surface 21 at the outer circumference 11*a* and the sides 11*c* and 11*d* (i.e., three positions) of the bobbin main body 11, so that compared to the conventional configuration where the partitions 12 are formed on only the surface 21 at the outer circumference 11*a*, it is possible to prevent collapsing of the windings of the conductive wire 50 that can cause fluctuations in the properties of the winding component 1 and to suppress contact between the unit windings 4*a* in adjacent winding regions F that can cause parasitic capacitance. Also, according to the bobbin 3 and the winding component 1, by constructing the individual partitions 12 so as to include the protrusions 32*a* and 32*b* that are formed so as to protrude from at least one of the two opening-side ends 41*a* and 41*b* of the flanges 31 (in the present embodiment, from both of the opening-side ends 41*a* and 41*b*), it is possible to suppress protrusion of the conductive wire 50 into other winding regions F that are adjacent, even at the inner circumference 11*b* of a winding region F where the flanges 31 are not formed. As a result, at the inner circumference 11*b* of the winding regions F also, it is possible to prevent collapsing of the windings and to suppress contact between the unit windings 4*a* in the respective adjacent winding regions F. Accordingly, with the bobbin 3 and the winding component 1, it is possible to sufficiently suppress fluctuations in the properties of the winding component 1 due to collapsing and parasitic capacitance caused by contact between the unit windings 4*a* in adjacent winding regions F.

With the bobbin 3 and the winding component 1, the flanges 31 are formed of U-shaped plates that protrude from the surface 21 at the outer circumference 11*a* and the sides 11*c* and 11*d* of the bobbin main body 11 but not at the inner circumference 11*b*. That is, the surface 21 of the inner circumference 11*b* is a partitionless position where the flanges 31 are not formed. Here, with a configuration where the flanges 31 are formed at the inner circumference 11*b* of the winding regions F where the length of the surface 21 is shorter than the length of the surface 21 at the outer circumference 11*a* and the length of the surface 21 at the sides 11*c* and 11*d*, the length of the surface 21 of the winding regions F at the inner circumference 11*b* will be even shorter, which makes "fattening" that can cause fluctuations in the properties more likely to occur. On the other hand, according to the bobbin 3 and the winding component 1, by setting the surface 21 of the inner circumference 11*b* as a partitionless position where the flanges 31 are not formed, compared to a configuration where the flanges 31 are formed at the inner circumference 11*b*, it is possible to suppress the occurrence of fattening. As a result, it is possible to sufficiently suppress fluctuations in the properties of the winding component 1 due to fattening.

According to the bobbin 3 and the winding component 1, by forming the protrusions 32*a* and 32*b* on both of the two opening-side ends 41*a* and 41*b* of the flanges 31, compared to a configuration where a protrusion 32 is formed on only one of the opening-side ends 41*a* and 41*b*, it is possible to further suppress the occurrence of collapsing of the windings at the inner circumference 11*b* of the winding regions F, and possible to further reduce fluctuations in the properties of the winding component 1 due to the collapsing of the windings.

Figure 9:
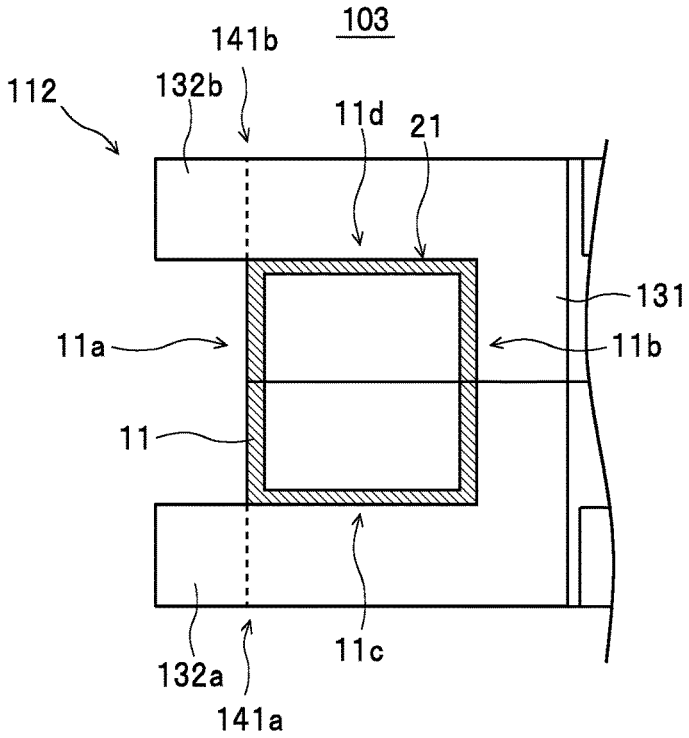
FIG. 9 is a partial cross-sectional view of a bobbin 103.

Note that the configurations of the winding bobbin and the winding component are not limited to the configurations described above. As one example, it is possible to configure a bobbin 103 depicted in FIG. 9 and a winding component 1 equipped with the bobbin 103. Note that in the following description, component elements that are the same as the bobbin 3 described above have been assigned the same reference numerals and duplicated description thereof is omitted. As depicted in FIG. 9, the bobbin 103 includes partitions 112 in place of the partitions 12 described above. As depicted in FIG. 9, the partitions 112 include flanges 131 and protrusions 132*a* and 132*b*.

As depicted in FIG. 9, the flanges 131 are formed of plates that are U-shaped in plan view that protrude perpendicularly from the surface 21 at three positions, namely the sides 11*c* and 11*d* and the inner circumference 11*b*, out of the outer circumference 11*a*, the inner circumference 11*b*, and the sides 11*c* and 11*d* of the bobbin main body 11, with the outer circumference 11*a* omitted as one example of "one position" for the present invention. That is, the surface 21 at the outer circumference 11*a* of the bobbin main body 11 is a partitionless position where the flanges 131 are not formed.

As depicted in FIG. 9, the protrusions 132*a* and 132*b* are formed so as to protrude in a direction (i.e., leftward in FIG. 9) that is opposite to a direction toward the center of the bobbin 103 from at least one of the two opening-side ends 141*a* and 141*b* of the flanges 131 (in the present embodiment, from both the opening-side ends 141*a* and 141*b*).

With the bobbin 103 also, by constructing the partitions 112 so as to include the flanges 131 formed of U-shaped plates that protrude from the surface 21 at the sides 11*c* and 11*d* and inner circumference 11*b* of the bobbin main body 11 (that is, at three positions) and the protrusions 132*a* and 132*b* that are formed so as to protrude from at least one of the two opening-side ends 141*a* and 141*b* of the flanges 131 (in the present embodiment, from both the opening-side ends 141*a* and 141*b*), it is possible to suppress collapsing of the individual windings. As a result, it is possible to sufficiently reduce both fluctuations in the properties of the winding component 1 due to collapsing and parasitic capacitance due to contact between unit windings 4*a* in adjacent winding regions F.

Figure 10:
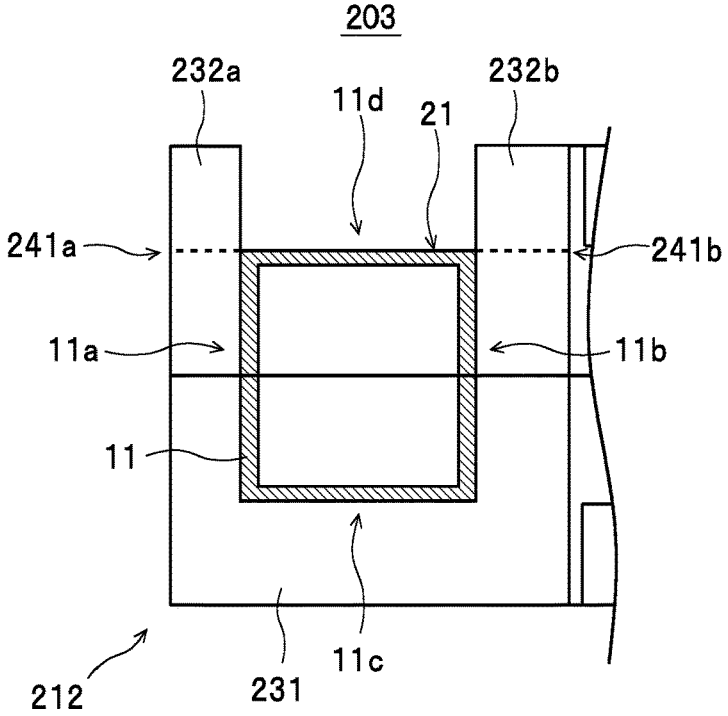
FIG. 10 is a partial cross-sectional view of a bobbin 203.

It is also possible to configure a bobbin 203 depicted in FIG. 10 and a winding component 1 equipped with the bobbin 203. Note that in the following description, component elements that are the same as the bobbin 3 described above have been assigned the same reference numerals and duplicated description thereof is omitted. As depicted in FIG. 10, the bobbin 203 includes partitions 212 in place of the partitions 12 described above. As depicted in FIG. 10, the partitions 212 include flanges 231 and protrusions 232*a* and 232*b*.

As depicted in FIG. 10, the flanges 231 are formed of plates that are U-shaped in plan view and protrude perpendicularly from the surface 21 at three positions, namely, the outer circumference 11*a*, the inner circumference 11*b*, and the side 11*c*, out of the outer circumference 11*a*, the inner circumference 11*b*, and the sides 11*c* and 11*d* of the bobbin main body 11, with the side 11*d* omitted as one example of "one position" for the present invention. That is, the surface 21 at the side 11*d* of the bobbin main body 11 is a partitionless position where the flanges 231 are not formed.

Also, as depicted in FIG. 10, the protrusions 232*a* and 232*b* are formed so as to protrude upward in FIG. 10 from at least one of the two opening-side ends 241*a* and 241*b* of the flanges 231 (in the present embodiment, from both the opening-side ends 241*a* and 241*b*).

With the bobbin 203 also, by constructing the partitions 212 so as to include the flanges 231 formed of U-shaped plates that protrude from the surface 21 at the outer circumference 11*a*, the inner circumference 11*b*, and the side 11*c* of the bobbin main body 11 (that is, at three positions), and the protrusions 232*a* and 232*b* that are formed so as to protrude from at least one of the two opening-side ends 241*a* and 241*b* of the flanges 231 (in the present embodiment, from both the opening-side ends 241*a* and 241*b*), it is possible to sufficiently reduce both fluctuations in the properties of the winding component 1 due to collapsing and parasitic capacitance due to contact between unit windings 4*a* in adjacent winding regions F.

Figure 11:
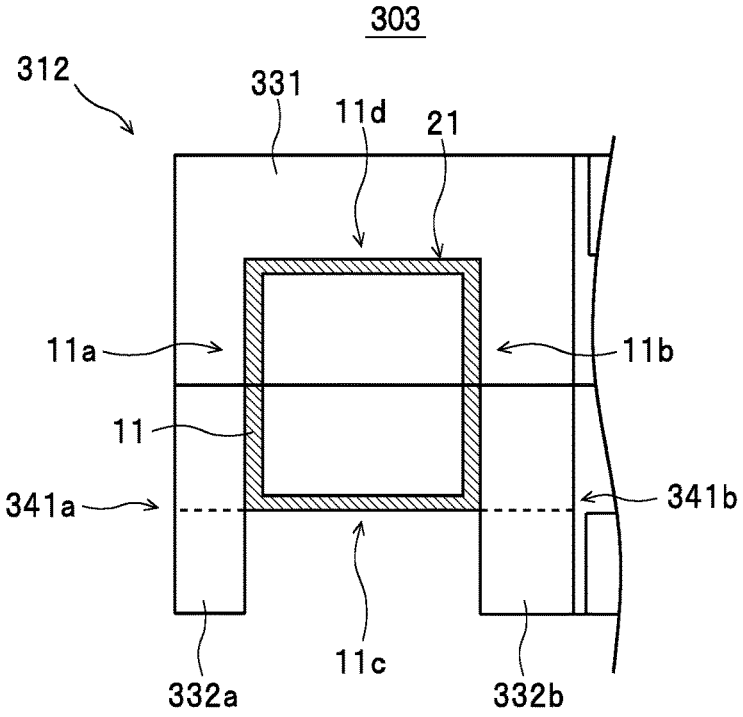
FIG. 11 is a partial cross-sectional view of a bobbin 303.

It is also possible to configure a bobbin 303 depicted in FIG. 11 and a winding component 1 equipped with the bobbin 303. Note that in the following description, component elements that are the same as the bobbin 3 described above have been assigned the same reference numerals and duplicated description thereof is omitted. As depicted in FIG. 11, the bobbin 303 includes partitions 312 in place of the partitions 12 described above. As depicted in FIG. 11, the partitions 312 include flanges 331 and protrusions 332*a* and 332*b*.

As depicted in FIG. 11, the flanges 331 are formed of plates that are U-shaped in plan view and protrude perpendicularly from the surface 21 at three positions, namely the outer circumference 11*a*, the inner circumference 11*b*, and the side 11*d*, out of the outer circumference 11*a*, the inner circumference 11*b*, and the sides 11*c* and 11*d* of the bobbin main body 11, with the side 11*c* omitted as one example of "one position" for the present invention. That is, the surface 21 of the side 11*c* of the bobbin main body 11 is a partitionless position where the flanges 331 are not formed.

Also, as depicted in FIG. 11, the protrusions 332*a* and 332*b* are formed so as to protrude downward in FIG. 11 from at least one of the two opening-side ends 341*a* and 341*b* of the flanges 331 (in the present embodiment, from both the opening-side ends 341*a* and 341*b*).

With the bobbin 303 also, by constructing the partitions 312 so as to include the flanges 331 formed of U-shaped plates that protrude from the surface 21 at the outer circumference 11*a*, the inner circumference 11*b*, and the side 11*d* of the bobbin main body 11 (that is, at three positions), and the protrusions 332*a* and 332*b* that are formed so as to protrude from at least one of the two opening-side ends 341*a* and 341*b* of the flanges 331 (in the present embodiment, both the opening-side ends 341*a* and 341*b*), it is possible to suppress the occurrence of collapsing, which means that it is possible to sufficiently reduce both fluctuations in the properties of the winding component 1 due to collapsing and parasitic capacitance due to contact between the respective unit windings 4*a* in adjacent winding regions F.

Although examples where the protrusions are formed on both of the two opening-side ends of the flanges have been described above, it is also possible to use configurations where a protrusion is formed on only one of the two opening-side ends.

Also, as depicted in FIG. 1, although the winding components 1 where the winding 4 is formed in every winding region F have been described as examples, it is also possible to use configurations where the winding 4 is formed in only some of the winding regions F.

Although examples where the bobbin 3 is constructed by the first member 3*a* and the second member 3*b* that are formed with the same thickness (or substantially the same thickness) have been described above, it is also possible to construct the bobbin 3 of the first member 3*a* and the second member 3*b* that are formed with respectively different thicknesses. It is also possible to construct the bobbin 3 from three or more members.

Also, although an example where the present invention is applied to the winding component 1 as a toroidal coil to be used for example as a current sensor has been described above, it is also possible for example to apply the present invention to a winding component that functions as a transformer constructed by forming a plurality of windings 4 that are not electrically connected on the winding component main body 10.

What is claimed is:

1. A winding bobbin comprising:

a bobbin main body constructed in a ring shape so as to be capable of housing a ring-shaped core; and a plurality of partitions that are provided at intervals in a circumferential direction of the bobbin main body and are formed so as to protrude from a surface of the bobbin main body, wherein a winding is formed by winding a conductive wire in winding regions on the surface that are partitioned by the partitions, and the partitions each include:

a flange that is formed of a U-shaped plate that protrudes from the surface at three positions out of four positions that are an outer circumference, an inner circumference, and two sides of the bobbin main body, with one position omitted; and a protrusion that is formed so as to protrude from at least one out of two opening-side ends of the flange.

2. The winding bobbin according to claim 1, wherein the flange is formed of the U-shaped plate that protrudes from the surface at three positions that do not include the inner circumference.

3. The winding bobbin according to claim 1, wherein the protrusion is formed on both of the two opening-side ends of the flange.

4. The winding bobbin according to claim 2, wherein the protrusion is formed on both of the two opening-side ends of the flange.

5. A winding component comprising:

a winding bobbin including a bobbin main body constructed in a ring shape so as to be capable of housing a ring-shaped core and a plurality of partitions that are provided at intervals in a circumferential direction of the bobbin main body and are formed so as to protrude from a surface of the bobbin main body, wherein a winding is formed by winding a conductive wire in winding regions on the surface that are partitioned by the partitions, and the partitions each include a flange that is formed of a U-shaped plate that protrudes from the surface at three positions out of four positions that are an outer circumference, an inner circumference, and two sides of the bobbin main body, with one position omitted, and a protrusion that is formed so as to protrude from at least one out of two opening-side ends of the flange;

the ring-shaped core that is housed in the winding bobbin; and the winding that is formed in the winding regions of the winding bobbin.

* * * * *